United States Patent [19]

Muller

[11] 4,139,191

[45] Feb. 13, 1979

[54] APPARATUS FOR CONVERTING A STREAM OF SHEETS INTO DISCRETE STACKS

[75] Inventor: Hans Müller, Zofingen, Switzerland

[73] Assignee: Grapha-Holding AG., Hergiswil, Switzerland

[21] Appl. No.: 787,574

[22] Filed: Apr. 14, 1977

[30] Foreign Application Priority Data

Apr. 23, 1976 [CH] Switzerland ..... 5116/76

[51] Int. Cl.[2] ..... B65H 29/34

[52] U.S. Cl. ..... 271/189; 271/218

[58] Field of Search ..... 271/189, 218, 3.1

[56] References Cited

U.S. PATENT DOCUMENTS 3,507,492 4/1970 Spencer ..... 271/218 X

FOREIGN PATENT DOCUMENTS 2314999 1/1974 Fed. Rep. of Germany ..... 271/218

*Primary Examiner*—Richard A. Schacher

*Attorney, Agent, or Firm*—Peter K. Kontler

[57] ABSTRACT

Apparatus for conversion of a stream of partially overlapping imprinted sheets into discrete stacks each of which contains a fixed number of fully overlapping sheets has a chute one side wall of which arrests successive foremost sheets of the stream and causes such sheets to descend in the chute and to pile up on top of each other, and a rotary separating device with three prongs which are moved seriatim from an upwardly inclined first position above the path of the stream to an upwardly inclined second position in which the respective prong intercepts the oncoming sheets of the stream, thereupon to a horizontal third position in which the respective prong continues to intercept the oncoming sheets and supports the lowermost intercepted sheet from below, and finally to a fourth position in which the respective prong allows the intercepted sheets to descend in the chute. The stacks of piled-up sheets are removed during the intervals between movements of successive prongs between their second and fourth positions. The drive which indexes the separating device is braked by a shock absorber during movement of successive prongs between the second and third positions. A counter transmits signals for operation of the drive when it receives a fixed number of signals from a sensor which furnishes signals in response to detection of successive sheets forming the stream.

10 Claims, 6 Drawing Figures

APPARATUS FOR CONVERTING A STREAM OF SHEETS INTO DISCRETE STACKS

BACKGROUND OF THE INVENTION

The present invention relates to apparatus for converting a stream of sheets, groups of sheets or analogous commodities into discrete stacks of overlapping commodities, especially for converting a continuous stream of partially overlapping identical imprinted sheet-like commodities into discrete stacks wherein the neighboring commodities are in accurrate register with each other.

It is already known to utilize a rotary separating element for interception of one or more oncoming signatures, discrete sheets or analogous commodities (hereinafter called sheets for short) upon completion of the assembly of a stack consisting of a predetermined number of sheets. The stream is supplied by one or more endless belts or analogous conveyors, and successive foremost sheets are caused to descend onto a platform where the sheets accumulate to form a stack. The separating element is located at the discharge ends of the conveyors and is caused to enter the path of an oncoming sheet when the platform accumulates a given number of sheets. Means is provided to withdraw the separating element as soon as the fully assembled stack is lifted off or otherwise removed from the platform.

In certain presently known apparatus, the separating element is mounted on a rotary shaft and is further movable up and down. Such complex movements of the separating element necessitate the provision of a rather complicated drive which is not only expensive but also prone to malfunction. Moreover, each insertion of the separating element into the path of oncoming sheets necessitates a full revolution of the shaft and a complete up- and down movement of the element. The frequency of movements of the separating element into and out of the path of oncoming sheets is limited owing to inertia of moving parts so that the output of apparatus embodying the just described separating elements is not entirely satisfactory, especially in modern printing plants for newspapers, books, brochures or the like.

OBJECTS AND SUMMARY OF THE INVENTION

An object of the invention is to provide an apparatus which can convert a stream of rapidly moving sheets or analogous commodities into discrete stacks each of which preferably contains the same number of commodities.

Another object of the invention is to provide the apparatus with novel and improved separating means for interrupting the stacking of sheets when a stack contains a predetermined number of sheets so that each fully grown stack can be removed from a platform or a like support before the support receives the foremost sheet of the next stack.

A further object of the invention is to provide the apparatus with a novel and improved drive for the separating means and to construct and assemble the separating means and the drive in such a way that the sheet-intercepting and supporting element or elements of the separating means can perform simple movements, always at a speed which is best suited for predictable and reproducible interception of oncoming sheets, for proper support of intercepted sheets during removal of a fully grown stack, and for rapid transfer of intercepted sheets onto the support as soon as the fully grown stack has been removed for further processing.

An additional object of the invention is to provide an apparatus which can properly stack sheets at the rate at which such sheets issue from a high-speed printing machine.

An ancillary object of the invention is to provide an apparatus which occupies little room; which can be used for stacking of commodities which constitute folded or unfolded single sheets, signatures or analogous groups of sheets, or combinations of such commodities; and which can be installed in existing bookbinding, newspaper printing or analogous plants as a superior substitute for existing apparatus.

The invention is embodied in an apparatus for converting a stream of sheets or analogous commodities into discrete stacks, particularly for converting a stream of partially overlapping imprinted sheets into stacks containing identical numbers of sheets. The apparatus comprises a system of conveyors or analogous means for feeding the stream along a first path (e.g., along a substantially horizontal path), means for directing successive foremost commodities of the stream into a second path wherein the commodities pile up on top of each other to form a growing stack (the directing means may constitute one side wall of an upright chute or duct having a retractible one-piece or composite bottom wall), a rotary separating device which is disposed between the first and second paths and comprises at least one prong or an analogous element which is indexible about a fixed axis between a plurality of positions including at least one first position in the first path and at least one second position outside of the first and second paths so that the element intercepts the oncoming foremost commodity or commodities in the one first position thereof and allows the thus intercepted commodities as well as the next-following foremost commodities to enter the second path in the one second position thereof, and drive means for repeatedly indexing the element between such positions.

In accordance with a presently preferred embodiment, the element is indexible from the one first position to another first position in which the element constitutes a substantially horizontal support for intercepted commodities, and the drive means includes means for indexing the element at a first speed to the one first position, at a lower second speed from the one to the other first position, and at a third speed from the other first to the one second position. The third speed exceeds the second speed.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
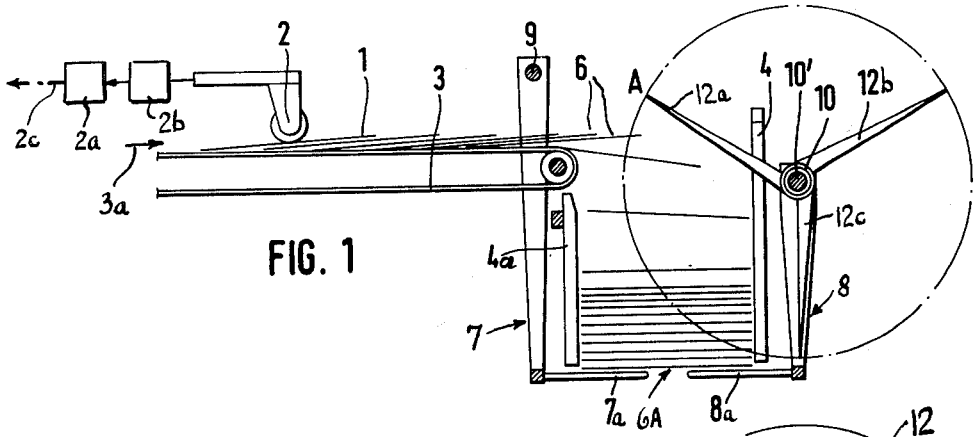
FIG. 1 is a schematic side elevational view of a portion of an apparatus which embodies the invention, the separating device comprising three equidistant prong-like elements and all of the elements being located outside of the first and second paths.
Figure 2:
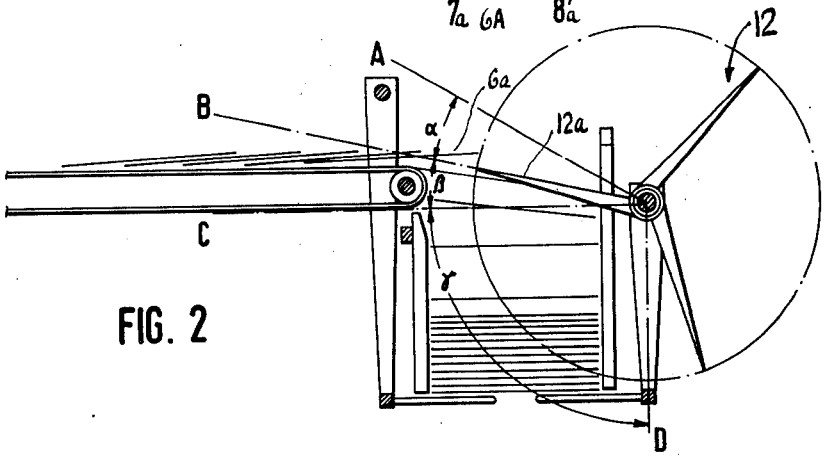
FIG. 2 shows the apparatus of FIG. 1 but with one of the elements indexed to the one first position in which it is about to intercept the incoming foremost commodity of the stream.
Figure 3:
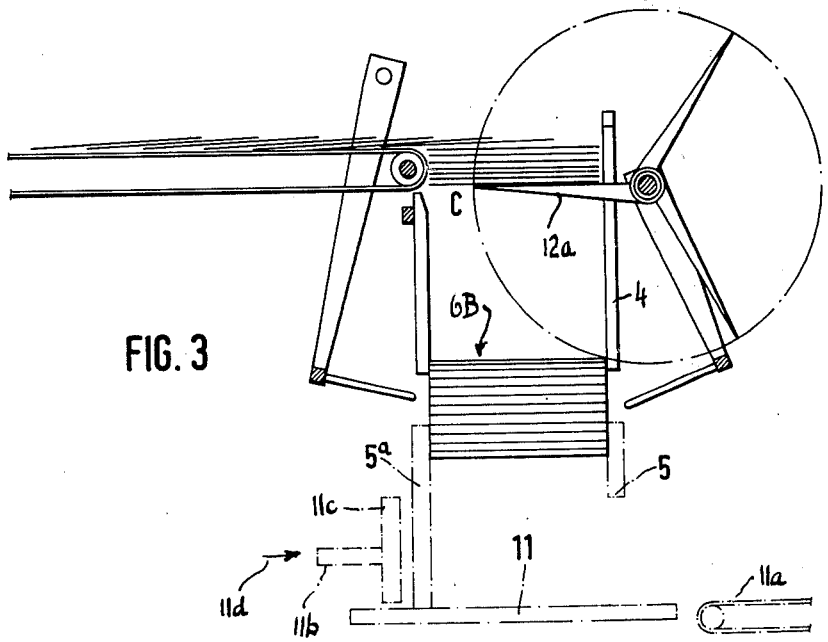
FIG. 3 shows the apparatus of FIG. 1 but with the one element in the other first position in which such element constitutes a substantially horizontal support for the intercepted commodities.

Referring to FIGS. 1 to 3, there is shown an apparatus which comprises one or more belts 3 or analogous conveyor means for feeding a continuous stream 1 of partially overlapping imprinted sheets 6 in the direction indicated by arrow 3*a*. The sheets 6 are supplied by a press or another suitable source, not shown. Successive sheets 6 of the stream 1 are detected by a sensor 2 which transmits appropriate signals to a counter 2*a*. The sensor 2 may include an idler wheel which rides on the stream 1 to rise whenever it is engaged by the leading edge of an oncoming sheet 6 and to thus actuate a microswitch 2*b* which causes the transmission of a signal to the counter 2*a*.

The conversion of sheets 6 into a growing stack 6A takes place immediately downstream of the discharge ends of the belts 3. The leader of the foremost sheet 6 strikes against a side wall 4 which cooperates with a shorter side wall 4*a* to define therewith an upright chute or duct wherein the sheets 6 descend along a vertical path toward a horizontal platform or table 11. The chute may have a square or rectangular cross-sectional outline. The side walls 4 and 4*a* may be apertured or each thereof may consist of several discrete or interconnected sections. The side wall 4 constitutes a means for directing successive foremost sheets of the stream 1 from a substantially horizontal first path into a substantially vertical second path wherein the sheets 6 pile up on top of each other.

The sheets 6 are permitted to descend all the way onto the platform 11 upon completed assembly of a fully grown stack 6B. To this end, the apparatus comprises one or more pivotable or reciprocable members 7, 8 having arms 7*a*, 8*a* which normally extend into the path of downward movement of the lowermost or foremost sheet 6 of a growing stack 6A and remain in the operative positions (shown in FIGS. 1 and 2) until after the mechanism which moves the members 7, 8 receives a signal from the output of the counter 2*a*. Such signal is transmitted when the input of the counter 2*a* receives a predetermined number of signals from the sensor 2. In the illustrated embodiment, the means for moving the members 7, 8 comprises two shafts 10', 9 which are connected to and support the upper ends of the upwardly extending arms of the members 7, 8. The operative connection between such moving means and the output of the counter 2*a* is indicated by a phantom line 2*c*. In order to be moved to the inoperative positions shown in FIG. 3, the members 7, 8 must be pivoted in opposite directions. The arms 7*a*, 8*a* constitute a retractible bottom wall of the chute including the side walls 4 and 4*a*.

The side walls 4 and 4*a* respectively register with grate-like upright guide members 5, 5*a* which are located above the platform 11 and guide successive fully grown stacks 6B on their way toward and onto the upper surface of the platform. The lower edge portion of the right-hand guide 5 is spaced apart from the upper side of the platform 11 so as to provide room for transfer of successive fully grown stacks 6B onto a take-off conveyor 11*a*. The means for transferring stacks 6B from the platform 11 onto the conveyor 11*a* comprises a reciprocable pusher 11*b* having one or more prongs 11*c* which can pass through the openings of the guide 5*a* to engage and shift the stack 6B in the direction indicated by arrow 11*d* when the pusher 11*b* performs a forward stroke.

Each movement of members 7, 8 to the inoperative or retracted positions of FIG. 3 is preceded by angular displacement of a rotary separating device 12 here shown as having a hub 10 surrounding the shaft 10' and three equally spaced elements or prongs 12*a*, 12*b*, 12*c* which extend radially outwardly of the hub 10. In FIG. 1, all three elements 12*a*–12*c* are spaced apart from the path of movement of sheets 6 from the discharge ends of conveyors 3 into the channel between the side walls 4 and 4*a*. Thus, the apparatus is in the process of accumulating a growing stack 6A the lowermost sheet of which rests on the bottom wall 7*a*, 8*a*.

In FIG. 2, the separating device 12 has completed an angular movement through an angle alpha (in a counterclockwise direction) whereby the prong 12*a* extends into the path of the oncoming sheet 6*a* while permitting the last sheet of a predetermined number of successive sheets to enter into and descend in the channel between the side walls 4 and 4*a*. The bottom wall 7*a*, 8*a* is thereupon moved to the retracted position of FIG. 3 and the fully grown stack 6B descends onto the platform 11. The bottom wall 7*a*, 8*a* is returned to the operative position of FIGS. 1 or 2 while or after the separating device 12 is turned through an angle beta so as to insure that the element 12*a* assumes the substantially horizontal position C of FIG. 2 which successive sheets 6 can accumulate on and are supported by its upper side. The separating device 12 is thereupon turned through the angle gamma so as to move the element 12*a* to the position corresponding to that occupied in FIG. 1 by the preceding element 12*c*. The sum of angles alpha, beta and gamma equals 120°.

Figure 6:
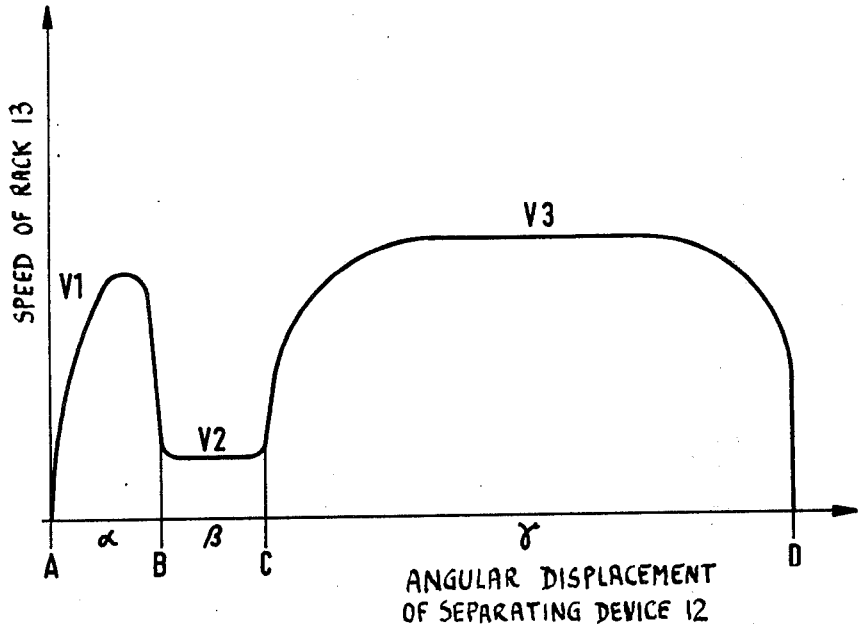
FIG. 6 is a diagram wherein the curve represents variations in speed of the separating device during a complete cycle including the movement of an element from another second position, through the two first positions, and to the one second position.

The operation is as follows:

A cycle begins when the element 12*a* of the separating device 12 assumes the upwardly inclined position A of FIG. 1 in which the element 12*a* is located at a level above the chute 4, 4*a*, 7*a*, 8*a* and above the path of sheets 6 forming the stream 1. As shown in the diagram of FIG. 6, the separating device 12 is rapidly accelerated so that the element 12*a* moves through the angle alpha and assumes the position B of FIG. 2 as the output of the counter 2*a* transmits a signal which indicates that the last sheet of a preselected number of sheets has been advanced beyond the tip of the element 12*a*, i.e., that the leader of such sheet is sufficiently close to the side wall 4 to insure that it cannot be intercepted by the element 12*a* when the latter moves from the position A to the position B. The oncoming sheet 6*a* (which belongs to the next stack) as well as the next-following foremost sheets of the stream 1 then slide along and are supported by the upper side of the element 12a (in the position B).

The separating device 12 is thereupon rotated at a reduced speed (see FIG. 6) through the angle beta, i.e., the element 12a is moved from the position B to a position C which is shown in FIG. 3 and in which the upper side of the element 12a is substantially horizontal. This insures that the fresh growing stack 6A (the sheet 6a is the lowermost sheet of such stack) contains accurately aligned (fully overlapping) sheets whose leaders abut against the side wall 4.

In the next-following step, the device 12 is rotated, at a high speed (see FIG. 6), through the angle gamma so that the element 12a moves from the position C to the position D and the next-following element 12b assumes the position A. The elements 12a–12c are then outside of the path of movement of sheets 6 from the conveyors 3 onto the bottom wall 7a, 8a. Furthermore, the movement of element 12a from the position C to the position D results in automatic deposition of the growing stack 6A from the upper side of the element 12a onto the upper side of the bottom wall 7a, 8a. As mentioned above, the sum of the angles alpha, beta and gamma equals 120° because the separating device 12 comprises three equally spaced prong-like elements.

If the sheets 6 are quite flexible, their leaders bend downwardly after moving beyond the discharge ends of the conveyors 3. This facilitates the entry of elements 12a, 12b, 12c of the separating device 12 between the last sheets of the growing stacks 6a and the next-following sheets of the stream 1. The positions B and C can be called first positions of the elements 12a–12c (in such positions, the respective elements extend into the first path, i.e., into the path of movement of successive foremost sheets which form the stream), and the positions A and D can be called second positions of the respective elements (in such second positions, the elements are located outside of the path of movement of sheets which form the stream 1 as well as outside of the path of movement of sheets in the chute 4, 4a, 7a, 8a).

Figure 4:
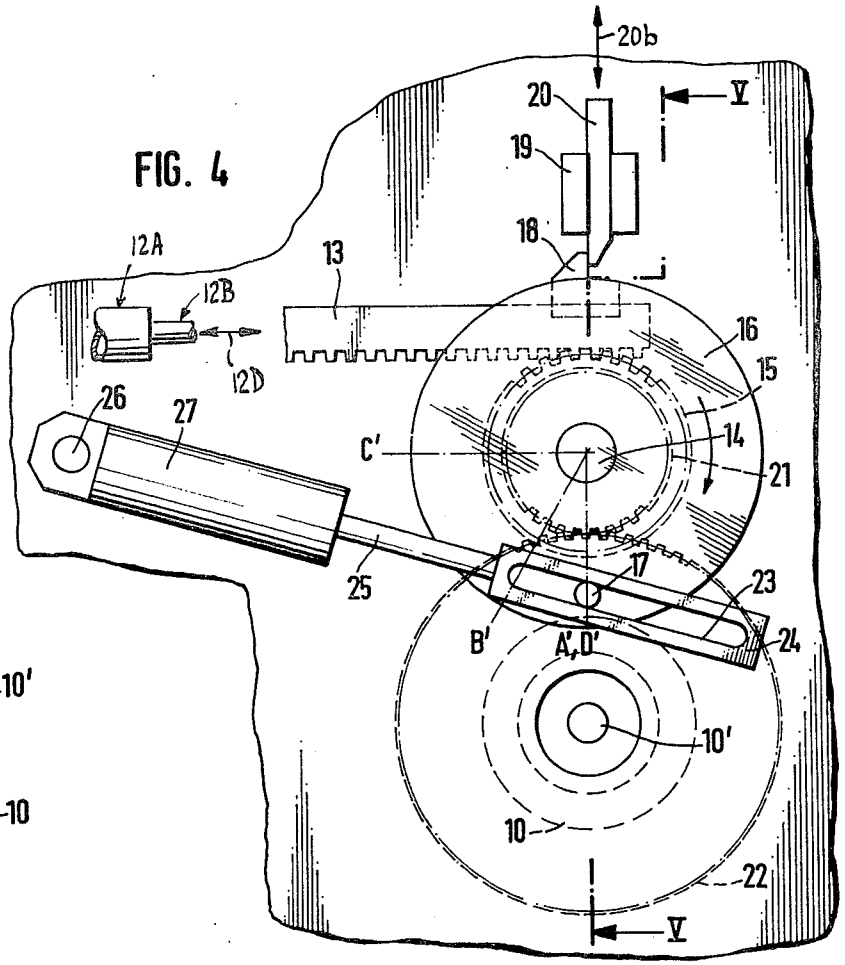
FIG. 4 is an elevational view of drive means for the separating device of FIGS. 1 to 3.
Figure 5:
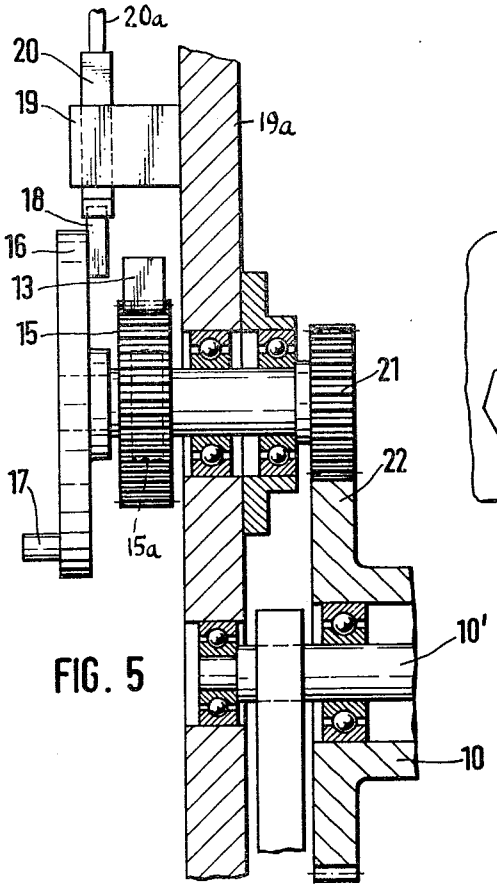
FIG. 5 is a sectional view as seen in the direction of arrows from the line V—V of FIG. 4.

The drive means for the separating device 12 is shown in FIGS. 4 and 5. Such drive means includes a prime mover 12A (preferably a double-acting pneumatic cylinder and piston unit) whose output element 12B (piston rod) is coupled to a toothed rack 13 and is reciprocable in directions indicated by the arrow 12D. The teeth of the rack 13 mesh with the teeth of a pinion 15 which is mounted on a drive shaft 14 through the medium of a one-way clutch 15a. The pinion 15 transmits torque to the shaft 14 when it is free to rotate in a clockwise direction, as viewed in FIG. 4.

The shaft 14 is rigid with an arresting wheel 16 having a pin-shaped orbitable eccentric first projection 17 which extends to one of its sides and a tooth-shaped radially extending second projection 18 which is located at the other side thereof. The projection 18 can be engaged and arrested by a stop 20 which is reciprocable in a bearing 19 mounted on a frame member 19a. The stop 20 is coupled to the piston rod 20a of a second fluid-operated (preferably pneumatic) cylinder and piston unit. The directions in which the piston rod 20a is reciprocable are indicated by the arrow 20b. The shaft 14 is further connected with a pinion 21 which is in mesh with a gear 22 rigidly secured to or integral with the hub 10 of the separating device 12. The pinion 21 and the gear 22 constitute a step-down transmission or gear train with a ratio of 3:1, i.e., the pinion 21 must complete three revolutions in order to rotate the separating device 12 through 360°. Otherwise stated, the device 12 turns through 120° in response to each full revolution of the shaft 14.

The projection 17 extends into the elongated slot 23 of a follower 24 which is connected to the piston 25 of a shock absorber 27 constituting a braking device for the wheel 16 and hence for the drive means for the separating device 12. The body or housing of the shock absorber 27 is pivotally secured to the frame member 19a or to another component of the frame of the apparatus by a pivot pin 26. The shock absorber 27 brakes the wheel 16 when the projection 17 reaches and moves beyond the seven o'clock position, as viewed in FIG. 4. The projection 17 then engages the surface at the left-hand end of the slot 23 and pushes the piston 25 into the body of the shock absorber 27. The braking action is terminated when the projection 17 reaches the nine o'clock position, as viewed in FIG. 4.

When the piston rod 12B of the cylinder and piston unit 12A tends to move in a direction to the right, as viewed in FIG. 4, because the corresponding chamber of the cylinder of the unit 12A is connected with a suitable source of pressurized fluid, the rack 13 remains at a standstill as long as the stop 20 extends into the path of movement of the tooth-shaped projection 18. When the stop 20 is withdrawn by the piston rod 20a (upwardly, as viewed in FIGS. 4 or 5), the piston rod 12B causes the rack 13 to rapidly rotate the wheel 16 whereby the projection 17 moves from the position A' to the position B' (these positions respectively correspond to the positions A and B of the element 12a shown in FIGS. 1 to 3, i.e., the element 12a is rapidly rotated through the angle alpha at a speed v1 and moves into the path of movement of the oncoming foremost sheet 6a as shown in FIG. 2). The wheel 16 thereupon continues to rotate clockwise, as viewed in FIG. 4, but at a reduced speed v2 (see FIG. 6) because the shock absorber 27 opposes such rotation of the wheel 16 since the projection 17 abuts against the surface bounding the left-hand end of the slot 23 and must push the piston 25 deeper into the body of the shock absorber. The braking action upon the drive means is terminated when the projection 17 reaches the position C' (corresponding to the horizontal position C of the element 12a shown in FIG. 2). From there on, the wheel 16 again rotates at a higher speed v3 (see FIG. 6) whereby the projection 17 moves to the position D' which coincides with the starting position A' of the projection 17 and corresponds to the position D of the element 12a. The stop 20 is returned to the arresting position of FIGS. 4 or 5 as soon as it is bypassed by the projection 18 so that it arrests the wheel 16 when the latter completes a full revolution, i.e., when the separating device 12 has completed an angular movement through 120°. The element 12b then assumes the position occupied by the element 12a of FIG. 1 and the element 12a assumes the position D.

The separating device may comprise a single prone-like element or two elements. The magnitude of the angle gamma decreases with the number of such elements. Thus, if the angle alpha equals 10° and the angle beta equals 20°, the angle gamma equals 90° provided that the separating device 12 has three equally spaced elements 12a–12c. If the number of elements is reduced to two, the ratio of the step-down transmission 21, 22 is 2:1 and the angle gamma equals 150°. The ratio of the transmission 21, 22 is 1:1 and the angle gamma equals 330° if the separating device comprises a single element.

The improved apparatus is susceptible of many additional modifications without departing from the spirit of the invention. For example, the shock absorber 27 can be replaced with a much simpler braking device or with a more complex braking device. A simple braking device may include a leaf spring which is adjacent the path of movement of the projection 17 between the positions B′ and C′ of FIG. 4. A more complex braking device may include a shock absorber and a second braking device, e.g., the just discussed leaf spring.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In an apparatus for converting a stream of sheets or analogous commodities into discrete stacks, particularly for converting a stream of partially overlapping imprinted sheets into stacks containing fully overlapping sheets, the combination of means for feeding said stream along a first path; means for directing successive foremost commodities of said stream into a second path wherein the commodities pile up on top of each other to form a growing stack; a rotary separating device disposed between said paths and having at least one element indexible about a fixed axis between a plurality of positions including at least one first position in said first path and at least one second position outside of said paths so that said element intercepts the oncoming foremost commodities in said one first position thereof and allows the thus intercepted commodities as well as the next-following foremost commodities to enter said second path in said one second position thereof, said element constituting a support for said intercepted commodities in said one first position thereof; and drive means for repeatedly indexing said element to said positions, including means for indexing said element to said one first position at first speed and to said one second position at a different second speed.

2. In an apparatus for converting a stream of sheets or analogous commodities into discrete stacks, particularly for converting a stream of partially overlapping imprinted sheets into stacks containing identical numbers of fully overlapping sheets, the combination of means for feeding said stream along a first path; means for directing successive foremost commodities of said stream into a second path wherein the commodities pile up on top of each other to form a growing stack; a rotary separating device disposed between said paths and having at least one element indexible about a fixed axis between a plurality of positions including one first position in said first path and at least one second position outside of said paths so that said element intercepts the oncoming foremost commodities in said one first position thereof and allows the thus intercepted commodities as well as the next-following foremost commodities to enter said second path in said one second position thereof, said element being further indexible from said one first position to another first position in which said element constitutes a substantially horizontal support for said intercepted commodities; and drive means for repeatedly indexing said element to said positions, including means for indexing said element at a first speed to said one first position, at a lower second speed to said other first position and at a third speed from said other first position to said one second position, said third speed exceeding said second speed.

3. The combination of claim 2, wherein said separating device includes three equidistant elements indexible seriatim at said first speed from another second position above said second path to said one first position, at said second speed from said one to said other first position and at said third speed from said other first position to said one second position, each of said elements completing an angle of substantially 120° during movement from said other second to said one second position thereof.

4. The combination of claim 2, further comprising means for braking said element during movement between said one and said other first position thereof.

5. The combination of claim 4, wherein said breaking means comprises a projection orbitable by said drive means about a second fixed axis and a shock absorber arranged to yieldably oppose the orbital movement of said projection during indexing of said element from said one to said other first position and to thereby decelerate said drive means.

6. The combination of claim 2, further comprising means for operating said drive means at intervals corresponding to those required to direct a predetermined number of commodities from said first into said second path.

7. The combination of claim 6, further comprising means for removing the piled-up commodities from said second path during movement of said element from said one first to said one second position thereof.

8. The combination of claim 2, wherein said drive means comprises a step-down transmission having an output member arranged to transmit torque to said element.

9. The combination of claim 2, wherein said feeding means is arranged to transport a stream of partially overlapping sheets along said first path and further comprising a chute which defines said second path and includes a plurality of side walls, one of said side walls constituting said directing means.

10. The combination of claim 2, wherein said drive means includes a fluid-operated prime mover, a toothed rack reciprocable by said prime mover, a pinion meshing with said rack, a shaft coaxial with said pinion, one-way clutch means interposed between said pinion and said shaft to rotate the latter while said pinion rotates in one direction and a gear train connecting said shaft with said separating device.

* * * * *